US007268683B2

(12) United States Patent
Andres et al.

(10) Patent No.: US 7,268,683 B2
(45) Date of Patent: Sep. 11, 2007

(54) HAZARD DETECTOR WITH THEFT DETECTION

(75) Inventors: John J. Andres, Chapel Hill, NC (US); Stan Burnette, Colorado Springs, CO (US); Joseph G. Deluca, Colorado Springs, CO (US); Travis Silver, Colorado Springs, CO (US)

(73) Assignee: Walter Kiddle Portable Equipment, Inc., Mebane, NC (US)

( * ) Notice: Subject to any disclaimer, the term of this patent is extended or adjusted under 35 U.S.C. 154(b) by 237 days.

(21) Appl. No.: 11/186,227

(22) Filed: Jul. 21, 2005

(65) Prior Publication Data

US 2007/0018818 A1 Jan. 25, 2007

(51) Int. Cl.
*G08B 13/14* (2006.01)

(52) U.S. Cl. ..... 340/571; 340/687; 340/568.3; 340/628

(58) Field of Classification Search ..... 340/571, 340/568.1, 687, 568.3, 665, 650, 628, 629, 340/630, 632, 652, 656, 538.17; 200/51.1, 200/61.59; 324/508, 511
See application file for complete search history.

(56) References Cited

U.S. PATENT DOCUMENTS 3,425,050 A * 1/1969 Tellerman et al. ..... 340/571
3,484,775 A 12/1969 Cline
3,618,065 A 11/1971 Trip et al.
4,037,223 A * 7/1977 Tucci et al. ..... 340/571
4,300,130 A 11/1981 Fotheringham et al.
4,380,760 A 4/1983 Kornblit
4,419,658 A 12/1983 Jarosz et al.
4,736,195 A 4/1988 McMurtry et al.
4,779,078 A 10/1988 Ciolli
4,812,827 A 3/1989 Scripps
4,893,324 A 1/1990 Scown
4,980,672 A 12/1990 Murphy
5,418,521 A * 5/1995 Read ..... 340/568.3
5,434,558 A * 7/1995 Zeder ..... 340/568.3
5,525,965 A 6/1996 Liebenthal (Continued)

FOREIGN PATENT DOCUMENTS

DE 35 03 791 A1 8/1986

(Continued)

*Primary Examiner*—Anh V. La
(74) *Attorney, Agent, or Firm*—Merchant & Gould P.C.

(57) ABSTRACT

A detector assembly is adapted to be removably secured to a female electrical receptacle connected to a power supply where the female receptacle is mounted at a surface of a structure. The detector apparatus includes a housing and an electrically powered circuit mounted in the housing. The circuit includes components operable to detect an alarm condition (such as carbon monoxide or smoke) and to provide an alarm in response to the detection. A primary power source includes a male electrical connector secured to the housing and extending outwardly there from. A secondary power source includes a battery connector mounted within the housing and adapted to removably receive a battery contained within the housing. The circuit is adapted to draw power from the secondary source in the event of a detected loss of power from the primary source. The apparatus includes a sensor for sensing displacement of the housing from the female electrical receptacle. The circuit is adapted to provide an alarm in response to the displacement of the housing from the mounted surface.

7 Claims, 3 Drawing Sheets

U.S. PATENT DOCUMENTS 5,574,436 A 11/1996 Sisselman et al.
5,694,118 A 12/1997 Park et al.
5,767,771 A 6/1998 Lamont
5,818,338 A 10/1998 Ferraro
5,966,079 A * 10/1999 Tanguay ..... 340/636.1
5,969,437 A 10/1999 Foerster
6,492,907 B1 12/2002 McCracken
6,790,076 B1 9/2004 Patterson

FOREIGN PATENT DOCUMENTS

DE 299 19 926 U1 3/2000
GB 2 276 970 A 10/1994

* cited by examiner

HAZARD DETECTOR WITH THEFT DETECTION

BACKGROUND OF THE INVENTION

1. Field of the Invention

This invention pertains to portable hazard detectors such as detectors for smoke, carbon monoxide or other environmental hazards. More particularly, this invention pertains to a hazard detector with a theft prevention feature.

2. Description of the Prior Art

Hazard detectors are well known for detecting hazards such as fire, smoke or carbon monoxide or the like. An example of such is found in U.S. Pat. No. 4,812,827 to Scripps, dated Mar. 14, 1998. The '827 patent describes a wall mounted smoke detector which is retained in place solely by reason of male electrical prongs received within a standard female electrical receptacle. The '827 patent teaches a battery contained within the smoke detector which acts as a back-up in the event the power system to the female receptacle fails. The apparatus of the '827 patent also includes a charger mechanism for charging the battery while the unit is plugged into a wall outlet.

Other examples of smoke detectors include U.S. Pat. No., 5,574,436 to Sisselman et al., dated Nov. 12, 1996 which includes a primary power source (such as a building power supply) and a battery. The apparatus sounds an alarm if loss of the primary source is detected. The supplementary power source is substantially non-removable by a consumer. Specifically, the '436 patent teaches a supplementary power source in the form of a battery which is completely enclosed in plastic and, thus, rendered substantially non-removable by a consumer in the absence of using physical force to alter the smoke detector's circuitry or housing. Other examples of such smoke detectors include U.S. Pat. Nos. 5,969,437; 4,893,324; 6,492,907; 4,779,078; 4,419,658; and 4,380,760.

Wall mounted smoke detectors such as that described in the aforementioned U.S. Pat. No. 4,812,827 can be made at reasonable prices to encourage their use in structures not otherwise provided with smoke detectors. As a result, low cost smoke detectors may be applied to retrofit existing structures to provide the safety benefits of smoke detection. Landlords or other non-resident owners may elect to put such devices in apartments. Pre-existing hotels and motels may elect to put such devices into guest rooms.

Unfortunately, individuals may elect to tamper with or steal portable smoke detectors. For example a hotel guest may steal a smoke detector where it is not physically secured to the structure but is only plugged into a wall outlet. In addition to stealing the smoke detector, individuals might elect to remove the smoke detector to obtain access to a battery compartment and steal the battery.

Anti-theft and anti-tampering devices are known. The aforementioned U.S. Pat. No. 5,574,436 attempts to prevent unauthorized removal of the battery by encasing a battery in plastic to prevent removal of a battery from a smoke detector. A number of other devices are known for preventing unauthorized removal of electronic equipment. For example U.S. Pat. No. 5,767,771 to Lamont, dated Jun. 16, 1998 describes disabling a computer if it is disconnected from a system and includes tamper detection circuitry. U.S. Pat. No. 5,525,965 to Liebenthal, dated Jun. 11, 1996 teaches an apparatus to sound an alarm in the event an attached appliance is unplugged. Similar apparatus are shown in U.S. Pat. No. 3,484,775 to Cline, dated Dec. 16, 1996; U.S. Pat. No. 3,618,065 to Trip, dated Nov. 2, 1971; U.S. Pat. No. 4,300,130 to Fotheringham et al., dated Nov. 10, 1981 and U.S. Pat. No. 4,736,195 to McMurtry et al., dated Apr. 5, 1988 as well as U.S. Pat. No. 5,818,338 to Ferraro, dated Oct. 6, 1998. It is an object of the present invention to provide a portable smoke detector which may be plugged into a wall and which will sound an alarm in the event it is removed from a wall outlet.

SUMMARY OF THE INVENTION

According to a preferred embodiment of the present invention, a detector assembly is disclosed where the detector assembly is adapted to be removably secured to a female electrical receptacle connected to a power supply and where the female receptacle is mounted at a surface of a structure. The detector apparatus includes a housing and an electrically powered circuit mounted in the housing. The circuit includes components operable to detect an alarm condition (such as carbon monoxide) and to provide an audible alarm in response to the detection. A primary power source includes a male electrical connector secured to the housing and extending outwardly there from. A secondary power source includes a battery connector mounted within the housing and adapted to removably receive a battery contained within the housing. The circuit is adapted to draw power from the secondary source in the event of a detected loss of power from the primary source. The apparatus includes a sensor for sensing displacement of the housing from the female electrical receptacle. The circuit is adapted to provide an audible alarm in response to the displacement of the housing from the mounted surface.

DETAILED DESCRIPTION OF THE PREFERRED EMBODIMENT

Figure 1:
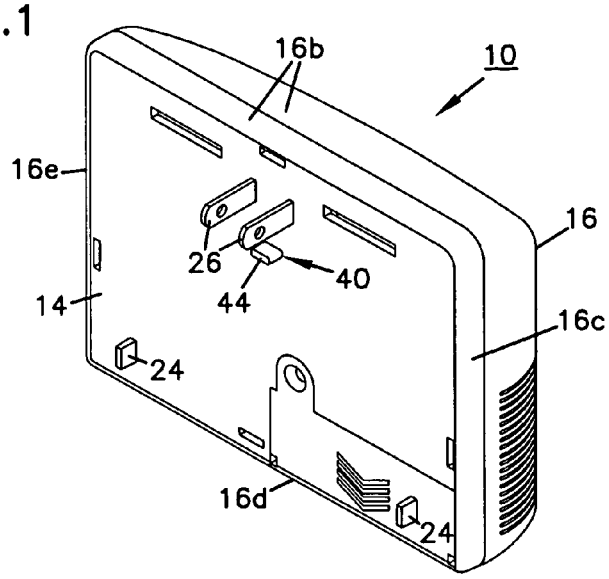
FIG. 1 is a back, top and side elevation view of a hazard detector apparatus according to the present invention.
Figure 2:
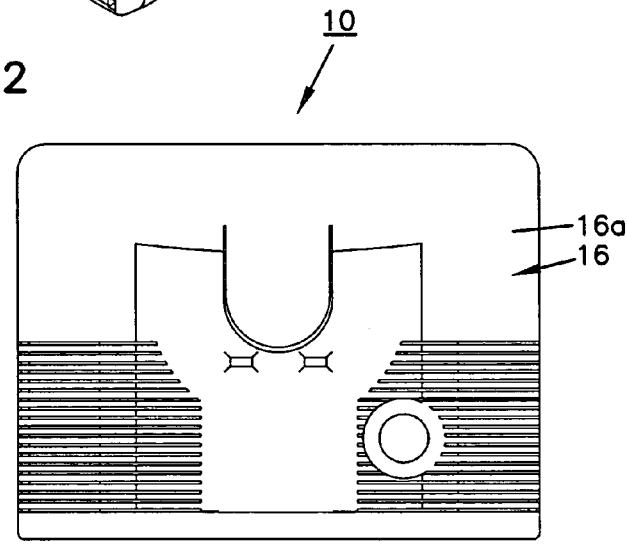
FIG. 2 is a front elevation view of the apparatus of FIG. 1.
Figure 3:
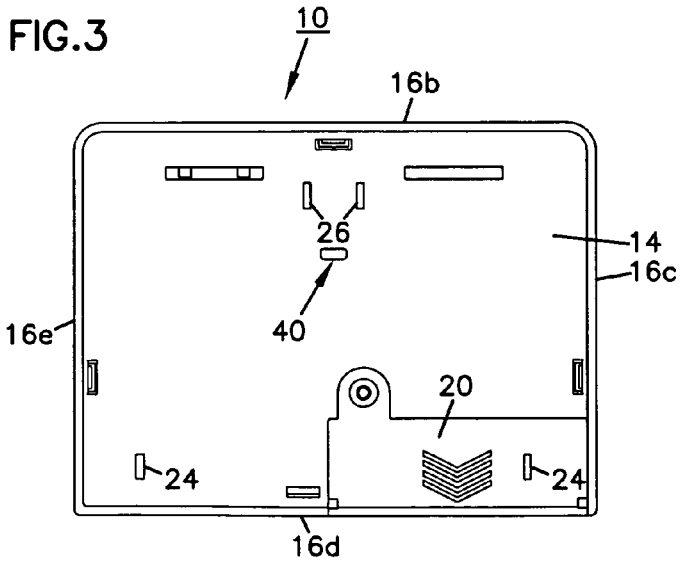
FIG. 3 is a rear elevation view of the apparatus of FIG. 1.
Figure 4:
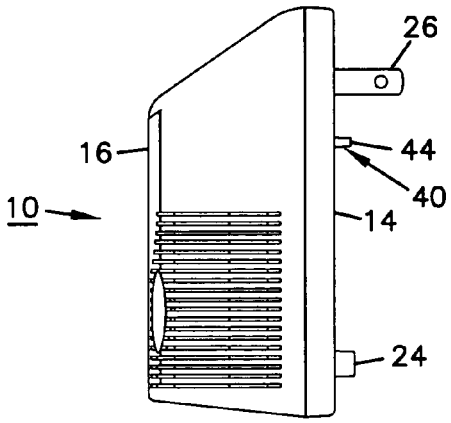
FIG. 4 is a side elevation view of the apparatus of FIG. 1.
Figure 5:
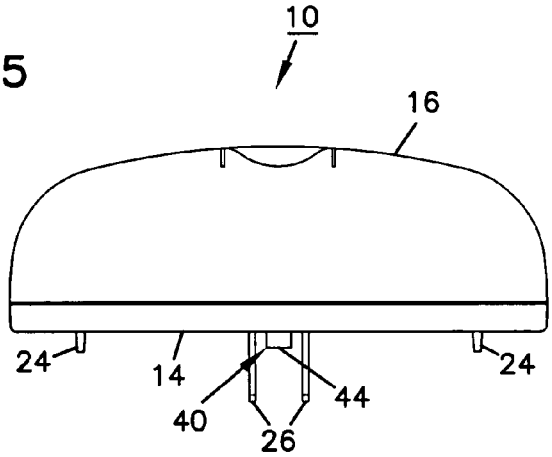
FIG. 5 is a top plan view of the apparatus of FIG. 1.
Figure 6:
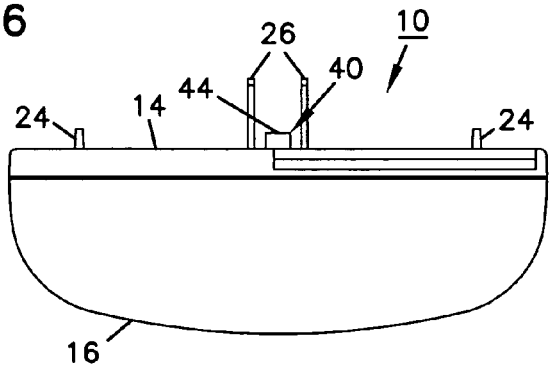
FIG. 6 is a bottom plan view of the apparatus of FIG. 1.
Figure 7A:
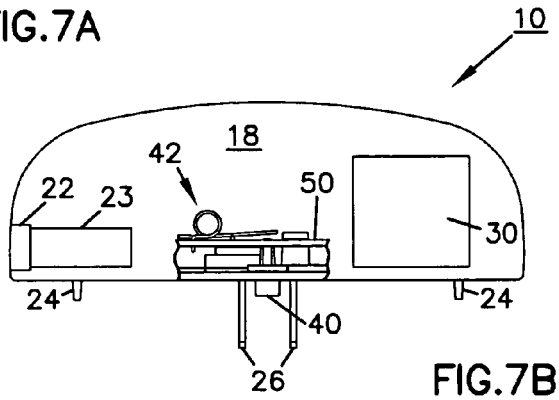
FIG. 7A is a schematic top sectional view of the apparatus of FIG. 1 schematically illustrating internal components.

Referring now to the several drawing figures in which identical elements are numbered identically throughout, a description of the preferred embodiment of the present invention will now be provided. The apparatus of the present invention is a hazard detector 10 for detecting an air-borne hazard such as smoke, carbon monoxide or the like. The detector 10 has a plastic housing including flat rear wall 14 attached to a cover 16. The cover has a front surface 16*a* and side surfaces 16*b*-16*e* to create an enclosed internal volume 18 (FIG. 7A).

The rear wall 14 includes an access panel 20, as is conventional, and which may be removed to expose a battery compartment including a battery connector 22. The connector 22 is for receiving and retaining within the compartment a conventional battery such as a 9-volt battery 23 or the like as is customary in smoke detectors. Standoff posts 24 are provided on the back wall 14 near edge 16*d* to permit the edge 16*d* to be slightly spaced from the flat wall of a building structure (not shown) when the detector 10 is mounted as will be described. A male electrical connector in the form of parallel spaced apart electrical prongs 26 extends perpendicularly away from the back wall 14 near an upper end 16*a*.

The interior 18 of the housing 12 also contains a circuit component 30 which is connected to the male electrical connector 26 as well as the internal battery component 22. The circuit component 30 includes a circuit having the following functions:

(a) Detection of a threat condition such as the presence of carbon monoxide, smoke or other air-borne hazard;

(b) An alarm for creating an audible alarm in response to a detection;

(c) A charger for charging the battery connected to the connector 22 and for receiving primary power from the connectors 26 and switching to the connector 22 as a back-up power in the event the primary power is lost.

It will be appreciated that a circuit forming these functions are well known within the art and form no part of this invention per se.

Figure 7B:
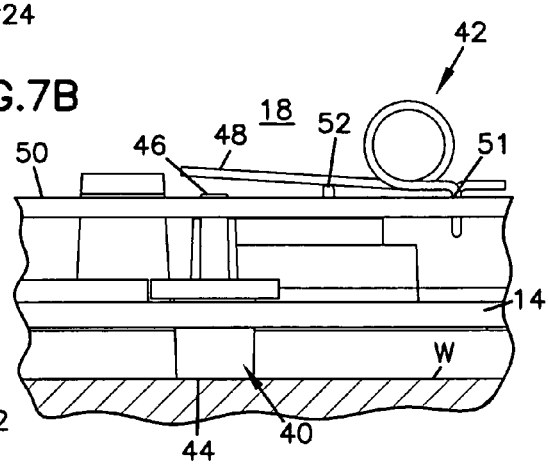
FIG. 7B is a view of an internal switch in a normally closed position.
Figure 7C:
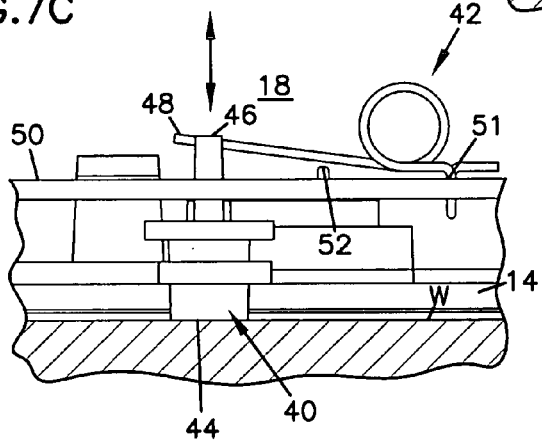
FIG. 7C is the view of FIG. 7B with the switch in an open position.
Figure 8:
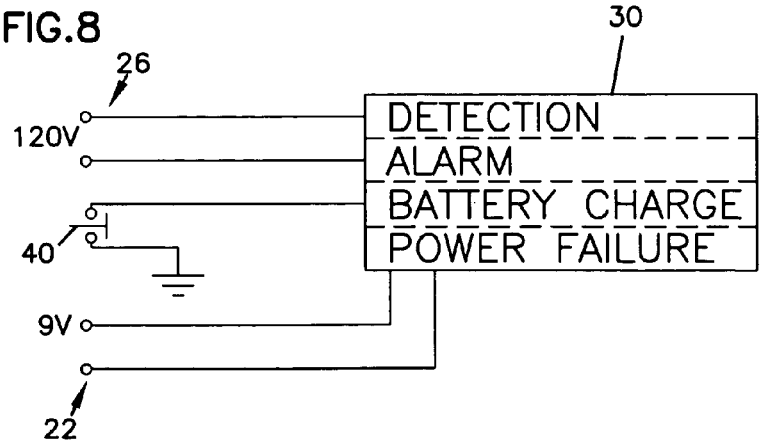
FIG. 8 is a schematic representation of a circuit for the apparatus of FIG. 1.

The apparatus 10 also includes a sensor for sensing a displacement of the apparatus 10 from the wall of a structure to which it has been mounted. The sensor includes a plunger 40 and a spring 42. The spring 42 is mounted on a platform 50 in interior 18 and spaced from the rear wall 14. The plunger 40 has an exposed first end 44 and an end 46 mounted within the housing. The plunger 40 moves in a direction (arrow A in FIG. 7C) substantially parallel to the prongs 26. The second end 46 of the plunger 40 is positioned to deflect a cantilevered end 48 of the spring 42 away from the platform 50 as illustrated in FIGS. 7B and 7C.

The spring 42 includes a first end 51 secured to the housing 12 and electrically grounded in any suitable manner. The cantilevered end 48 is disposed to oppose an electrical contact 52 connected to the circuitry 30.

The spring 42 and contact 52 are a normally closed switch. The closed switch is connected to electrical ground. The circuitry is selected for the alarm circuitry to issue an audible alarm when the switch 42 is closed. The switch is maintained in an open position by reason of the end 46 of the plunger 40 urging the cantilevered end 48 of the spring 42 away from the contact 52. The plunger 40 has its free end 44 exposed from the rear wall 14 with the plunger 40 having a length sized for the end 44 to abut an opposing surface W of a building structure when the prongs 26 are received within a female electrical receptacle of the structure. Accordingly, with the prongs 26 fully seated within a female receptacle and with the rear wall 14 opposing the wall W of a building, the plunger 44 is depressed urging the contact 42 to an open position electrically spaced from contact 52 (FIG. 7B).

Accordingly, any individual seeking to steal the apparatus 10 or to remove the apparatus 10 from a wall for the intent of stealing the battery, must first remove the apparatus 10 from the wall W resulting in the spring 42 contacting the contact 52 and issuing an audible alarm. The alarm acts as a deterrent to such removal thereby decreasing the likelihood of theft of the apparatus 10 or theft of the battery 23. While an audible alarm is a preferred embodiment of an alarm in the event the spring contact is made, the alarm could be a wireless transmission to a remote control unit. For example, a wireless transmission of an alarm can be sent to a control unit at a front desk of a motel to alert a desk attendant of the possibility of theft of the detector or the battery. It will be appreciate that a wireless transmission to a central locations is within the skill of the art.

It will be noted that the plunger end 44 is spaced within close proximity to the prongs 26 and positioned in a line extending between the prongs 26 to prevent tilting of the apparatus 10 relative to a wall structure and obtaining access to the plunger 40. Further, the distance from the prong 44 to the edges 16*c*, 16*d*, 16*e* is preferably selectively to be greater than the distance from the knuckles to the fingertips of an adult individual to prevent a person from sliding their hand behind the apparatus 10 attempting to maintain depression on the plunger 44 while removing the apparatus 10.

In a preferred embodiment, the circuit component 30 includes programmable components to achieve the following functions:

1. Anti-Theft Mode (ATM): ATM is entered immediately (subject to restrictions below) when the detector is not mounted on the wall (i.e., the plunger 44 is not depressed), the circuit component 30 is in ATM with alarm sounding. In ATM, the detector emits a continuous tone but continues to sense carbon monoxide. When placed on a wall with the plunger depressed, the detector circuit components terminates ATM and functions normally sensing for a hazard.
2. If a hazard (carbon monoxide) is detected, the detector goes into carbon monoxide alarm which overrides ATM.
3. The detector may include a reset button. Such button is disabled when in ATM. Maintenance Override: In order to ease normal battery replacement, the detector will not go into ATM if the reset button is pressed while removing the alarm from the wall. If the battery is not removed within two minutes, the detector will enter ATM.
4. If detector is not mounted on the wall within two minutes of the battery being installed, the detector will go into ATM.
5. If the detector is in a low battery or hibernate state and is removed from the wall, it will not go into ATM. If the detector enters a low battery state while in ATM, it will continue to emit the anti-theft tone.
6. If the detector is in ATM, the only way to silence it is to remove the battery or replace the detector back on the wall.

It will be appreciated that programming a hazard detector to achieve the above functions is well within the skill in of the art.

In the foregoing detailed description of the preferred embodiment, it has been shown how the objects of the present invention have been attained in the preferred embodiment. For example, the apparatus can be provided with a switch mechanism to hold the plunger in a depressed state and thereby disable the anti-theft feature. Such a switch may be mounted within the interior of the housing and accessible with a tool uniquely shaped and sized to pass through an opening in the housing and engage the switch. Such a tool of unique dimensions prevents unauthorized disablement of the anti-theft feature. Modifications and equivalents of the disclosed concepts are intended to be included within the scope of the claims, which are appended hereto.

We claim:

1. A detector assembly adapted to be removably secured to a female electrical receptacle connected to a power supply and with said female receptacle mounted at a surface of a structure comprising:

a housing, electrically powered circuit mounted in said housing, said circuit including components operable to detect an alarm condition and to provide an alarm in response to said detection;

a primary power source including a male electrical connector secured to said housing and extending outwardly therefrom to form an independent mounting support for said housing, said male electrical connector being configured to be removably engageable in said female electrical receptacle and being operative to complete an electrical circuit therewith to receive power therefrom and deliver said power to said circuit;

a secondary power source including a battery connector mounted within said housing and adapted to removably receive a battery contained within said housing;

said circuit adapted to draw power from said secondary source in the event of a detected loss of power from said primary source;

a sensor for sensing displacement of said housing from said surface of said structure;

said circuit further adapted to provide an audible alarm in response to said displacement.

2. A detector assembly according to claim 1 wherein said housing includes a back surface opposing said surface of said structure when said male connector is mated with said female receptacle, said sensor including a member protruding from said back surface and biased to extend from said back surface.

3. A detector assembly according to claim 2, wherein said male electrical connector and mounting means includes an electrical plug unit having at least two spaced conductive prongs projecting from said housing, said protruding member disposed between said prongs.

4. A detector assembly according to claim 1, wherein said circuit includes a battery charger connected to receive power from said primary power circuit and connected to said battery connector to provide charging power to said battery.

5. A detector assembly according to claim 1, wherein said alarm condition is the presence of a hazardous level of carbon monoxide in air.

6. A detector assembly according to claim 1, wherein said alarm is an audible alarm.

7. A detector assembly according to claim 1, wherein said alarm is a wireless transmission to a remote location.

* * * * *